US006391152B1

(12) United States Patent
Dahllof et al.

(10) Patent No.: US 6,391,152 B1
(45) Date of Patent: May 21, 2002

(54) PROCESS FOR THE OXYGEN DELIGNIFICATION OF PULP IN TWO STAGES WITH HIGHER PRESSURE IN THE SECOND STAGE

(75) Inventors: Hakan Dahllof, Edsvalla; Martin Ragnar, Karlstad, both of (SE)

(73) Assignee: Kvaerner Pulping AB, Karlstad (SE)

( * ) Notice: Subject to any disclaimer, the term of this patent is extended or adjusted under 35 U.S.C. 154(b) by 22 days.

(21) Appl. No.: 09/592,135

(22) Filed: Jun. 12, 2000

(30) Foreign Application Priority Data

Jul. 6, 1999 (SE) ..... 9902586

(51) Int. Cl.[7] ..... D21C 9/147
(52) U.S. Cl. ..... 162/19; 162/65
(58) Field of Search ..... 162/19, 65, 57, 162/52, 246, 68

(56) References Cited

FOREIGN PATENT DOCUMENTS

| | | |
|---|---|---|
| SE | 80067010 | 9/1980 |
| SE | 505 141 | 6/1997 |
| WO | WO 9630586 | 10/1996 |
| WO | WO 9715715 | 5/1997 |
| WO | 98/23810 | * 6/1998 |

* cited by examiner

*Primary Examiner*—Steve Alvo
(74) *Attorney, Agent, or Firm*—Fasth Law Offices; Rolf Fasth

(57) ABSTRACT

A system and a process for the oxygen delignification of pulp consisting of lignocellulose-containing material whose mean concentration is 8–18% pulp consistency, in at least two stages. The invention is characterized in that the oxygen delignification takes place in a first stage with a short dwell time of approx. 3–6 minutes, at a low temperature of approx. 85° C. and under a low pressure of approx. 0–4 bar, followed by a concluding stage with a longer dwell time of approx. 50–90 minutes, at a higher temperature of approx. 100° C. and under a higher pressure of approx. 8–10 bar. This makes it possible, in an industrial process, to exploit the kinetics of the oxygen delignification in an optimal manner for the purpose of obtaining a selective oxygen delignification at low installation cost and at low operating cost.

8 Claims, 2 Drawing Sheets

PROCESS FOR THE OXYGEN DELIGNIFICATION OF PULP IN TWO STAGES WITH HIGHER PRESSURE IN THE SECOND STAGE

The present invention relates to a system and to a process for oxygen delignification.

BACKGROUND AND SUMMARY OF THE INVENTION

A number of different processes for oxygen delignification have been disclosed. U.S. Pat. No. 4,259,150 presents a system involving a multistage oxygen bleaching in which the pulp is, in each stage, firstly mixed to a lower consistency with $O_2$, water and NaOH, followed by a thickening back to the consistency level which the pulp had up until the stage in question. The aim is to achieve an economical, chlorine-free bleaching with a high yield. At the same time, the kappa number can be lowered, by means of repeated stages, from 70 down to 15, or even to less than 15.

SE-C 467 582 presents an improved system for the oxygen bleaching of pulp of medium consistency. By means of the temperature control having been optimized, an oxygen bleaching takes place in a first delignification zone at low temperature, followed by a second delignification zone which is at a temperature which is 20–40 degrees higher. The aim was to obtain an improved yield and an improved viscosity, while retaining the same dwell time, in connection with industrial implementation.

Besides SE-C 467 582, other variants of oxygen delignification in two stages have also been patented. SE-C 505 147 presents a process in which the pulp is to have a high pulp concentration, in the range of 25–40%, in the first stage and a concentration of 8–16% in the second stage, at the same time as the temperature in the second stage is to be higher than, or the same as, the temperature in the first stage, in line with the temperature difference which is recommended in SE-C 467 582. The advantages of the solution in accordance with SE-C 505 147 are stated to be the possibility of admixing more oxygen in the first high-consistency stage without the risk of channel formation but where, at the same time, unused quantities of oxygen can be bled off after the first stage for further admixture in a second mixer prior to the second stage.

SE-C 505 141 presents yet another process which is an attempt to circumvent SE-C 467 582 since that for which a patent is sought is stated to be the fact that the temperature difference between the stages does not exceed 20°, i.e. the lowest suitable temperature difference patented in SE-C 467 582, but that a temperature difference should nevertheless be present. In addition to this, it is stated that a) the pressure should be higher in the first stage and b) that the dwell time is short in the first stage, i.e. of the order of size of 10–30 minutes, and c) the dwell time in the second stage is longer, i.e. of the order of size of 45–180 minutes.

A lecture entitled "Two-stage MC-oxygen delignification process and operating experience", which was given by Shinichiro Kondo, from the Technical Div. Technical Dept. OJI PAPER Co. Ltd., at the 1992 Pan-Pacific Pulp & Paper Technology Conference ('99 PAN-PAC PPTC), Sept. 8–10, Sheraton Grande Tokyo Bay Hotel & Towers, presents a successful installation which involves two-stage oxygen delignification and which was constructed in 1986 in a plant in Tomakomai. In this OJI PAPER plant in Tomakomai, the pulp was fed, at a pressure of 10 bar, to a first oxygen mixer (+steam), followed by an aftertreatment in a "pre-retention tube" (prereactor) involving a dwell time of 10 minutes in which the pulp pressure is reduced to a level of about 8–6 bar due to pipe losses, etc. After that the pulp was fed into a second oxygen mixer, followed by an aftertreatment in a reactor at a pressure of 5–2 bar and with a dwell time of 60 minutes. At this point it was stated that preference would have been given to having a "preretention tube" which would have given a dwell time of about 20 minutes but that it was not possible to achieve this due to lack of space. OJI PAPER stated that, by using this installation, they were successful in achieving an increase in kappa reduction for a lower cost in chemicals and also an improvement in pulp viscosity.

The greater part of the prior art has consequently been aimed at a higher pressure in the first reactor at a level of about 6(8)–10 bar. A pressure in the first reactor of up to 20 bar has even been discussed in some extreme applications. This entails the reactor spaces which are required for the first delignification zone having to be manufactured so as to withstand these high pressure levels, with the attendant requirement for substantial material thickness and/or good material qualities, resulting in an expensive installation.

In pulp suspensions used in industrial manufacturing processes, there are large quantities of readily oxidizable constituents/structures which react even under modest process conditions. It is therefore advantageous to add oxygen in a first stage in quantities which are such that this relatively readily oxidized part of the pulp is allowed to oxidize/react first of all. Severe problems arise if an attempt is made to compensate for this by adding too much oxygen, since there is the imminent problem of channelling (as mentioned in the said SE-C 505 147).

One aim of the invention is to avoid the disadvantages of the prior art and to obtain an oxygen delignification of increased selectivity. The invention permits an optimal practical application of the theories regarding a first rapid phase and a second slower phase during the oxygen delignification process, where the optimal reaction conditions are different between the phases.

At the high hydroxide ion concentrations and high oxygen partial pressures which are conventionally employed in the first stage, the carbohydrates are attacked more than necessary, thereby impairing the quality of the pulp.

A lower oxygen partial pressure, and preferably a lower temperature as well, in the first stage than in the second stage decreases the rate of reaction for breaking down carbohydrates more than it decreases the rate of reaction for the delignification, thereby leading to an increased total selectivity on the pulp after the two stages.

Another aim is to allow the process installation to be simpler and cheaper, with it being possible for at least one pressure vessel in a first delignification zone to be manufactured using less robust material and/or a lower material quality which is suitable for a lower pressure class.

Yet another aim is to optimize the mixing process in each position such that only that quantity of oxygen is added which is consumed in the following delignification zone. This makes it possible to dispense with bleeding systems for surplus quantities of oxygen at the same time as it is possible to reduce the total consumption of oxygen, which in turn reduces the operating costs for the operator of the fibre line and consequently shortens the pay-off time.

Yet another aim is to increase, in an oxygen delignification system having a given total volume of the first and second stages, a so-called H factor by running the first stage for a short time at low temperature and the second stage for a longer time at a higher temperature. When, for example, carrying out conversions of existing single-vessel oxygen delignification stages, a simple new construction with a small prereactor, and a modest increase in the reaction temperature in the existing reactor, can increase the H factor and at the same improve the selectivity over the oxygen stages.

The invention is described in more detail with reference to the figures in accordance with the following figure list.

DETAILED DESCRIPTION

Figure 1:
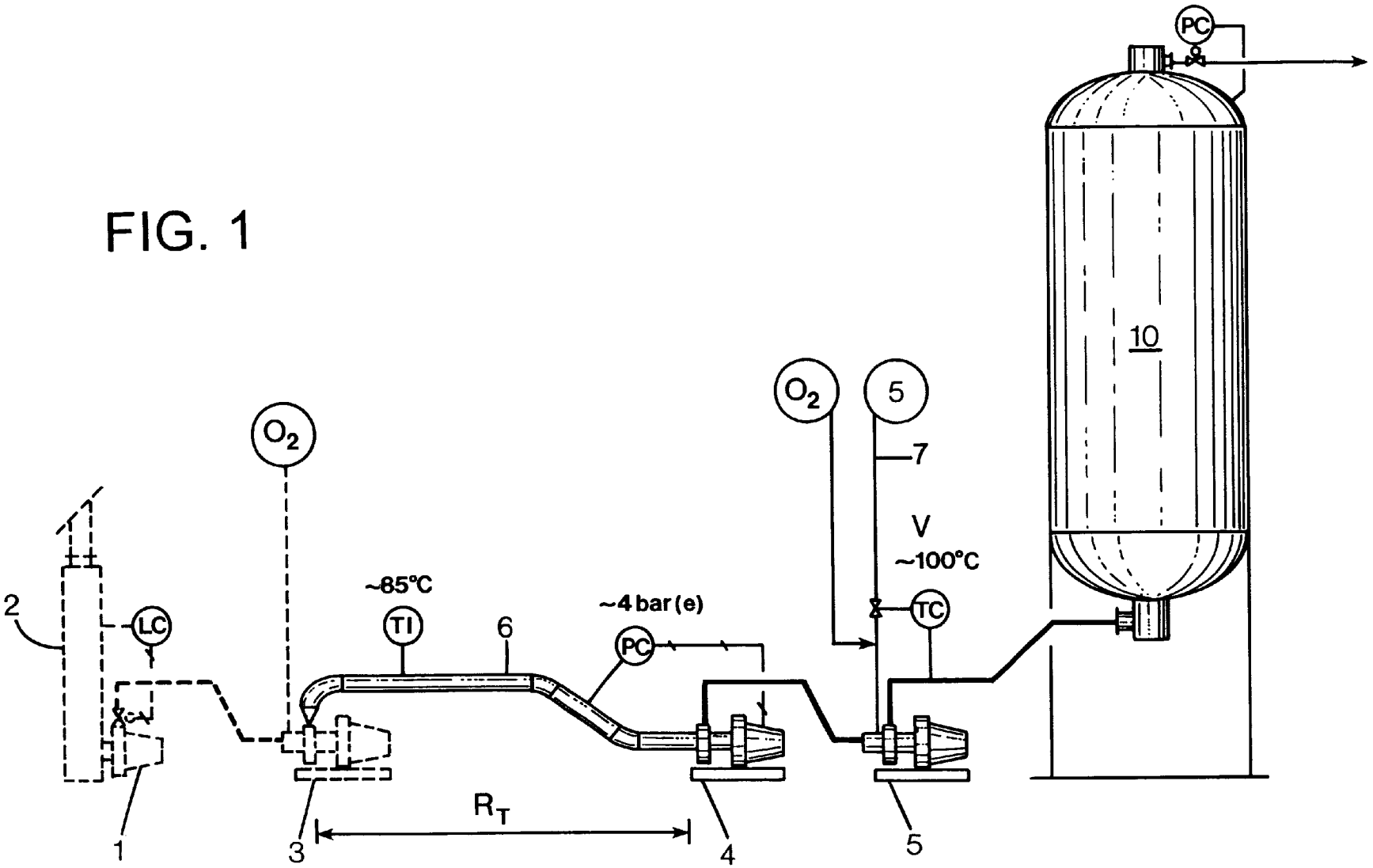
FIG. 1; shows a system for oxygen delignification in two stages in accordance with the invention.

FIG. 1 shows an installation, according to the invention, of a system in an existing plant in which the oxygen delignification process needed upgrading.

An existing first MC pump 1 (MC=medium consistency, typically a pulp consistency of 8–18%) is connected to a tipping chute 2 for forwarding to an existing first MC mixer 3.

An admixture of oxygen takes place in the first MC mixer 3, after which the pulp was, in the existing system, fed to an oxygen reactor 10.

The combination of a first MC pump 1 followed closely by an MC mixer 3 can be termed a "perfect pair". This is the case since the pump primarily pressurizes the pulp flow to a given degree, thereby facilitating a finely divided supply of the oxygen to the MC mixer which follows directly thereafter.

In accordance with the invention, an upgrading of the oxygen delignification is achieved by introducing a second MC pump 4 and a second MC mixer 5 which acts immediately thereafter, that is a second "perfect pair" combination.

The system is assembled such that the coupling pipe 6 forms a first delignification zone between the outlet of the first MC mixer and the inlet of the second MC pump, which zone gives rise to a dwell time RT Of between 2 and 20 minutes, preferably 2–10 minutes, and even more advantageously 3–6 minutes.

The second MC pump 4 is controlled such that the resulting pressure in the dwell line 6 is preferably in the interval 0–6 bar, preferably 0–4 bar. Preferably, the second pump 4 is controlled by means of its rotational speed being controlled by a control system PC depending on the pressure which prevails, and is detected, in the first delignification zone 6.

The temperature in the first delignification zone can be kept low, preferably at the level which the system allows without adding steam, but nevertheless with the pulp entering the first delignification zone being at a temperature of about 85° C., ±10° C.

The second MC pump 4 and the second MC mixer 5 are connected in after the first delignification zone. This second "perfect pair" combination is controlled such that the resulting pressure in the oxygen reactor 10, which forms a second delignification zone, reaches a level of at least 3 bars overpressure at the top of the reactor. The pressure in the second mixer should be at least 4 bar higher than the pressure in the first mixer; alternatively, the increase in pressure in the second pump should reach 4 bar. In connection with practical implementation in conventional oxygen stages, an initial pressure is obtained within the interval 8–10 bar, corresponding to the pressure at the inlet to the reactor.

The temperature of the pulp in the second delignification zone can expediently be increased by supplying steam to the second mixer. The supply of steam is expediently controlled using a control system TC, which comprises a control valve V on the line 7 for the steam supply and a feeding-back measurement of the temperature of the pulp which is leaving the mixer. The temperature is expediently raised to a level of 100° C.±10° C., but preferably at least 5° C. higher than the temperature in the first delignification zone.

The volume of the second delignification zone, i.e. the second reactor, is expediently designed such that it is at least 10 times greater than the volume of the first delignification zone, i.e. at least 20–200 minutes, preferably 20–100 minutes and even more advantageously within the range 50–90 minutes.

Figure 2:
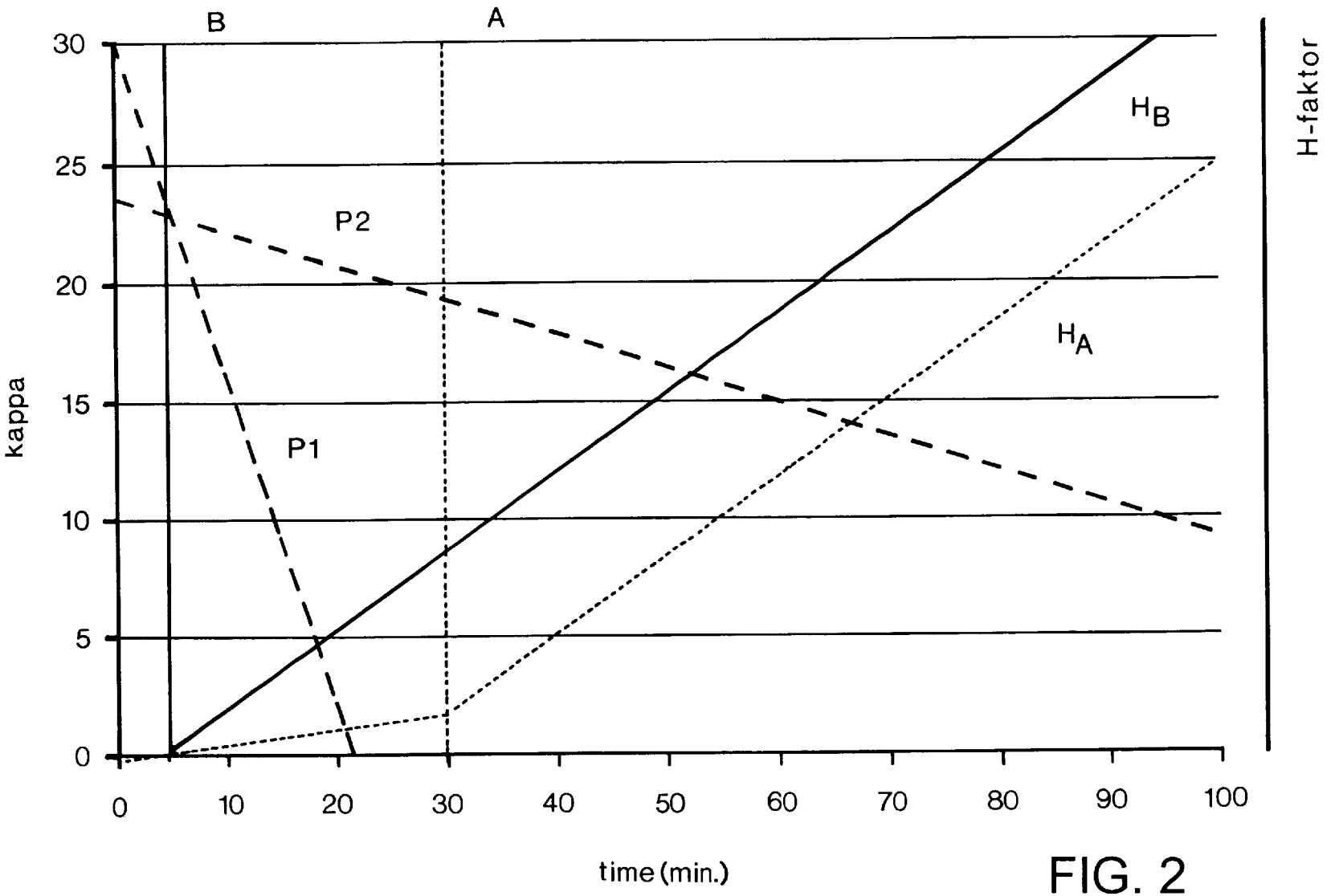
FIG. 2; diagrammatically shows the kinetics of oxygen delignification and the advantages which are gained relative to the prior art with regard to reduction in kappa number and an increased H factor.

FIG. 2 diagrammatically shows the kinetics of the oxygen delignification and the advantages with regard to the principles of kappa number reduction which are obtained relative to the prior art.

Curve P1 shows the principle of a reaction course during the initial phase of the delignification. This part of the delignification proceeds relatively rapidly and is typically essentially complete after a good 20 minutes.

However, after a relatively short time, typically only 5–10 minutes, the final phase P2 of the delignification takes over and begins to dominate as far as the resulting delignification of the pulp is concerned. A typical subdivision of the delignification into two stages in accordance with the prior art is shown at line A, with stage 1 being to the left of the line A and stage 2 being to the right of the line A. It follows from this that two different dominating processes, i.e. the initial phase of the delignification on the one hand, but also its final phase, actually take place in stage 1. It can be concluded from this that it becomes impossible to optimize the process conditions in stage 1 for both these delignification phases. Instead, a subdivision of the delignification into two stages in accordance with the invention is shown at the line B, where stage 1 is to the left of the line B and stage 2 is to the right of the line B. This makes it possible to optimize each stage for the process which dominates in the stage. The curve $H_A$ shows the temperature integral plotted against time (the H factor) which is typically obtained when implementing a delignification process in two stages in accordance with the prior art, corresponding to the line A.

As can be seen from the figure, it is possible to use the stage subdivision in accordance with the invention to obtain an H factor which is higher than that which is typically obtained in current installations. This can be done without foregoing demands for high selectivity over the oxygen delignification system. The invention also opens up ways of upgrading, with a small investment, an existing 1-stage process of comparatively low selectivity to a 2-stage system of better selectivity without having to build a new large reactor or even two such reactors. According to the invention, the initial phase of the oxygen delignification is dealt with in the prereactor, after which the temperature can, if so required, even be increased in the reactor which is present in association with the conversion, and an increased H factor can in this way be combined with increased selectivity.

The invention can be modified in a number of ways within the context of the inventive concept. For example, the first delignification zone can consist of a "preretention tube" which is vertical but in which the pressure in some part of this "preretention tube", including its bottom, is at least 4 bar lower than the pressure in the initial part of the second delignification zone.

Further delignification zones, or intermediate washing/leaching or extraction of the pulp, can be introduced between the first and second delignification zones according to the invention. For example, a third "perfect pair" combination, i.e. a pump with a mixer following, can be arranged between the zones. What is essential is that the first delignification zone is characterized by a lower pressure, a short dwell time and a moderate temperature, and that the concluding, final delignification zone is characterized by a higher pressure (a pressure which is at least 4 bar higher than that of the first zone), a longer dwell time (a dwell time which is at least 10 times longer than that in the first zone) and an increased temperature (a temperature which is preferably at least 5 degrees higher than that in the first zone).

Where appropriate, it should be possible to charge a first mixer, or an intermediate mixer in a third "perfect pair" combination, at least partially with oxygen which is blown off from the reactor 10. The economic basis for such a recovery of oxygen is poor since the cost of oxygen is relatively low.

In order to guarantee optimal process conditions, one or other, preferably the second, or both of the MC pumps can be rotation speed-controlled in dependence on the pressure in the first delignification zone.

The invention can also be modified by the addition of a number of different chemicals which are selected and suitable for the specific fibre line and the pertaining pump quality, such as agents for protecting cellulose, for example $MgSO_4$ or other alkaline earth metal ions or compounds thereof;

additions of complexing agents which are made prior to adding oxygen, with subsequent removal of precipitated metals, where appropriate;

chlorine dioxide;

hydrogen peroxide or organic or inorganic peracids or salts thereof;

free radical-capturing agents, such as alcohols, ketones, aldehydes or organic acids; and carbon dioxide or other additives.

Where appropriate, it should also be possible to degas exhaust gases (residual gases) in immediate conjunction with the second pump, preferably by means of the pump being provided with internal degassing, preferably a pump termed a "degassing pump".

What is claimed is:

1. A process for the oxygen delignification of a pulp consisting of a lignocellulose-containing material having an average concentration of 8–18%, comprising:

in a first stage, performing oxygen delignification in which the pulp is being treated for a first time period about 2–20 minutes in a first pressure of about 0–6 bar and at a temperature of between about 75–95° C.; and in a concluding stage, treating the pulp for a second time period that is being longer than the first time period, and at an over-pressure that is being at least 4 bar higher than the first pressure in the first stage, and at a temperature of between about 90–110° C.

2. The process according to claim 1 wherein the temperature is the concluding stage is at least 5° C. higher than the temperature in the first stage.

3. The process according to claim 1 wherein the pulp is treated for between about 2–10 minutes in the first stage.

4. The process according to claim 1 wherein the pulp is treated for between about 3–6 minutes in the first stage.

5. The process according to claim 1 wherein the first pressure in the first stage is between about 0–4 bar.

6. The process according to claim 1 wherein an oxygen delignification in the concluding stage takes place at a pressure of between about 8–10 bar.

7. The process according to claim 1 wherein the second time period is between about 20–100 minutes.

8. The process according to claim 1 wherein the second time period is between about 50–90 minutes.

* * * * *